US009828805B2

(12) United States Patent
Gunsaulis

(10) Patent No.: US 9,828,805 B2
(45) Date of Patent: Nov. 28, 2017

(54) REAMER WITH REPLACEABLE CUTTERS

(71) Applicant: The Charles Machine Works, Inc., Perry, OK (US)

(72) Inventor: Floyd R. Gunsaulis, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 682 days.

(21) Appl. No.: 14/250,194

(22) Filed: Apr. 10, 2014

(65) Prior Publication Data

US 2014/0305708 A1 Oct. 16, 2014

Related U.S. Application Data

(60) Provisional application No. 61/810,524, filed on Apr. 10, 2013.

(51) Int. Cl.

| | |
|---|---|
| ***E21B 7/04*** | (2006.01) |
| ***E21B 10/26*** | (2006.01) |
| ***E21B 7/20*** | (2006.01) |
| ***E21B 7/30*** | (2006.01) |

(52) U.S. Cl.

CPC ..... *E21B 7/046* (2013.01); *E21B 7/205* (2013.01); *E21B 7/30* (2013.01); *E21B 10/26* (2013.01)

(58) Field of Classification Search

CPC . E21B 7/046; E21B 7/205; E21B 7/30; E21B 10/26; E21B 10/28; E21B 10/30; E21B 17/1078

See application file for complete search history.

(56) References Cited

U.S. PATENT DOCUMENTS

| | | | | |
|---|---|---|---|---|
| 1,156,147 A | | 10/1915 | Karns | |
| 1,873,327 A | * | 8/1932 | Reed | E21B 10/20 175/369 |
| 1,932,488 A | * | 10/1933 | Scott | E21B 10/26 175/406 |
| 1,937,742 A | * | 12/1933 | Brink | E21B 10/003 175/383 |
| 4,190,124 A | * | 2/1980 | Terry | E21B 10/26 175/325.4 |
| 4,379,494 A | * | 4/1983 | Sheshtawy | E21B 17/1078 175/325.2 |

(Continued)

FOREIGN PATENT DOCUMENTS

| | | | | |
|---|---|---|---|---|
| AU | 2004100150 A | | 3/2004 | |
| DE | WO 03010409 A1 | * | 2/2003 | E21B 7/28 |

OTHER PUBLICATIONS

Drillstar Industries, "PDC Hole Opener", catalog page, May 25, 2012, 1 page.

*Primary Examiner* — Michael Wills, III

(74) *Attorney, Agent, or Firm* — Tomlinson McKinstry, P.C.

(57) ABSTRACT

A reamer for use in horizontal directional drilling back-reaming operations. The reamer comprises an elongate body having an intermediate section, a first end, and a second end. The circumference of the intermediate section is larger than the circumference of the first end and the second end. A pocket or a plurality of pockets are formed on the intermediate section. The pockets are configured such that a cutter or a plurality of cutters may be secured within the pockets via the use of fasteners. The cutters are replaceable with cutters of like size or cutters of different sizes and shapes.

9 Claims, 7 Drawing Sheets

(56) References Cited

U.S. PATENT DOCUMENTS

| | | | | |
|---|---|---|---|---|
| 4,508,184 | A * | 4/1985 | Hansen | E21B 10/30 175/346 |
| 4,662,461 | A * | 5/1987 | Garrett | E21B 17/1078 175/325.4 |
| 5,487,426 | A * | 1/1996 | O'Hair | E21B 17/1071 166/241.4 |
| 6,250,403 | B1 * | 6/2001 | Beckwith | E21B 7/28 175/53 |
| 6,622,803 | B2 * | 9/2003 | Harvey | E21B 17/1014 166/241.3 |
| 6,776,247 | B1 * | 8/2004 | Bassal | E21B 17/1078 166/241.2 |
| 6,926,100 | B1 * | 8/2005 | Anthony | E21B 7/28 175/406 |
| 7,000,713 | B2 * | 2/2006 | Crooks | E21B 10/30 175/325.3 |
| 7,243,737 | B2 * | 7/2007 | Michael | E21B 10/26 175/385 |
| 9,085,945 | B2 * | 7/2015 | Heieie | E21B 7/28 |
| 2005/0092526 | A1 * | 5/2005 | Fielder | E21B 10/322 175/57 |
| 2010/0175927 | A1 * | 7/2010 | Zulak | E21B 10/633 175/413 |
| 2012/0132469 | A1 * | 5/2012 | Robson | E21B 17/1078 175/53 |
| 2012/0211280 | A1 * | 8/2012 | Dewey | E21B 10/322 175/57 |
| 2013/0133954 | A1 * | 5/2013 | Mohon | E21B 10/28 175/345 |
| 2013/0248254 | A1 | 9/2013 | Ainge | |

* cited by examiner

REAMER WITH REPLACEABLE CUTTERS

CROSS-REFERENCE TO RELATED APPLICATION

This application claims the benefit of provisional patent application Ser. No. 61/810,524, filed on Apr. 10, 2013, the entire contents of which are incorporated herein by reference.

FIELD

The present invention relates generally to directional boring and, in particular, to a reamer assembly for enlarging an existing borehole.

SUMMARY

The present invention is directed to a reamer for use in horizontal directional drilling operations. The reamer comprises an elongate body, a pocket, a cutter, a passage, a clamp bushing, and a fastener. The elongate body comprises an intermediate section, a first end, and a second end. The intermediate section has a circumference larger than the circumference of the first end and the second end. The pocket is formed on the intermediate section. The cutter is configured to fit within the pocket and comprises a hole. The passage is formed within the intermediate section and intersects the pocket at an angle. The clamp bushing is disposed within the passage. The fastener is disposed within the passage, the clamp bushing, and the hole and is secured to the intermediate section.

The present invention is also directed to a reamer for use in horizontal directional drilling operations, wherein the reamer comprises an elongate body and a pocket. The elongate body comprises an intermediate section, a first end, and a second end. The intermediate section has a circumference larger than the circumference of the first end and the second end. The pocket is formed along the length of the intermediate section. The pocket comprises a cutter having a plurality of cutting elements and comprising a hole, a passage formed within the intermediate section that intersects the pocket at a right angle, and a fastener disposed within the passage and the hole and secured to the intermediate section. In addition, a portion of the cutter is parallel to the longitudinal axis of the elongate body.

The present invention is further directed to a method for assembling a reamer used in horizontal directional drilling operations. The method comprises the steps of providing an elongate body comprising an intermediate section, a first end, and a second end, wherein the intermediate section has a circumference larger than the circumference of the first end and the second end, and forming a pocket on the intermediate section. The method further comprises the steps of forming a passage within the intermediate section that intersects the pocket at an angle, inserting a cutter comprising a hole into the pocket, inserting a clamp bushing through the passage, passing a fastener through the passage, the clamp bushing, and the hole, and securing the fastener to the intermediate section of the elongate body.

The present invention is also directed to a method for enlarging a borehole formed during horizontal directional drilling operations using a reamer. The method comprises the steps of inserting a cutter into at least one pocket formed on an intermediate section of an elongate body of the reamer, wherein a portion of the cutter is parallel to the longitudinal axis of the elongate body, and securing the cutter to the intermediate section of the elongate body. The method further comprises the steps of connecting a first end of the elongate body to a drill pipe, connecting a second end of the elongate body to a swivel, and pulling the reamer through the borehole while rotating the reamer such that the cutter contacts and enlarges the borehole.

DESCRIPTION

Horizontal directional drills or boring machines may be used to replace or install underground utilities with minimal surface disruption. The machines utilize a series of drilling pipes joined end to end, at an entry access point, to form a drill string. The drill string may be attached to a downhole tool which bores underground forming a borehole and pulling the drill string behind it. Once the downhole tool reaches a target point for the completion of the borehole, a reamer may be attached to the drill string or the downhole tool and pulled back through the borehole to enlarge the bore and install a new pipe or a utility service. This may be referred to as back-reaming. One difficult application for reamers is enlarging boreholes formed in rock or other solid formations. Reamers that operate in such formations are especially prone to wear.

Figure 1:
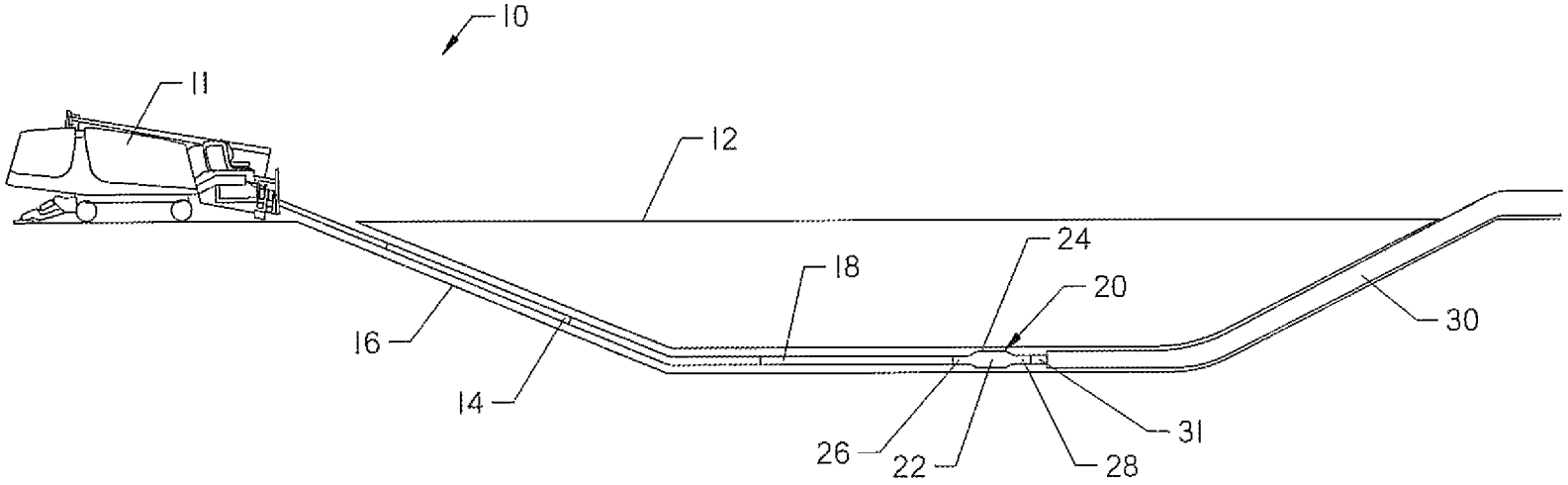
FIG. 1 is an illustration of a horizontal directional drilling back-reaming operation.

Turning now to the figures and first to FIG. 1, a horizontal directional drilling back-reaming operation 10 is shown. A boring machine 11 is shown on a ground surface 12. A drill string 14 is shown extending from the boring machine 10 and into a borehole 16. The borehole 16 is formed by a downhole tool (not shown) that drills underground. The drill string 14 comprises a plurality of drill pipe sections 18 connected end to end. A reamer 20 is shown connected to the drill string 14 within the borehole 16. The reamer 20 may also be connected to the downhole tool if the downhole tool is not removed from the borehole 16 before back-reaming operations begin.

Continuing with FIG. 1, the reamer 20 comprises an elongate body 22. The elongate body 22 comprises an intermediate section 24, a first end 26, and a second end 28. The first end 26 of the reamer 20 may be connected to the drill pipe 18 or the downhole tool (not shown). The second end 28 of the reamer 20 may be connected to a utility service 30 via a swivel 31. The utility service 30 may include one or more pipes, one or more cables, or one or more conduits for use with buried utilities. The swivel 31 may also be formed as an integral part of the reamer 20. Alternatively, the second end 28 of the reamer 20 may be directly connected to the utility service 30. In operation, during the back-reaming or pull-back portion of directionally drilled installation, the boring machine 20 will rotate and retract pipe sections 18 from the drill string 14 which in turn pulls the reamer 20 and the utility service 30 through the borehole 16. The reamer 20 enlarges the borehole 16 to make room for the utility service 30 by shearing away the sides of the borehole 16 as the reamer is pulled through the borehole. The reamer 20 may rotate as it is pulled through the borehole 16 to shear away the circumference of the borehole.

Figure 2:
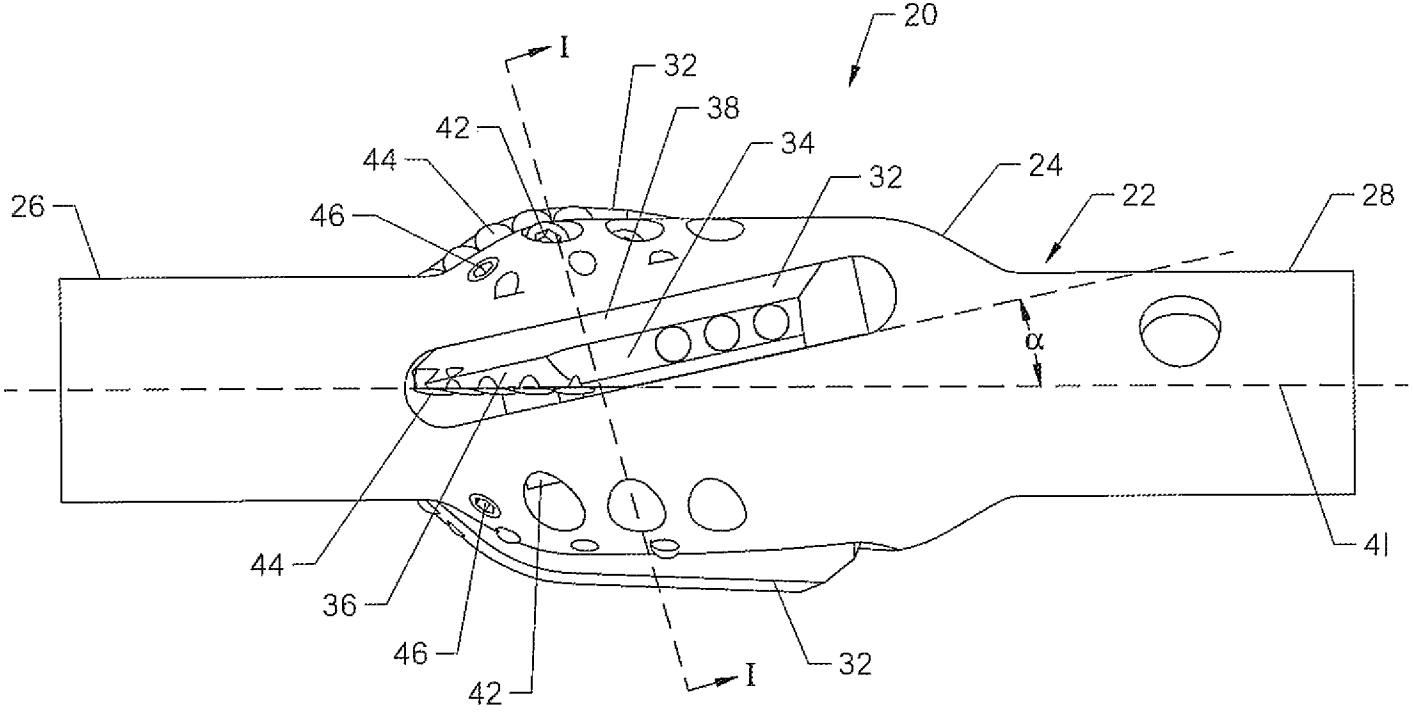
FIG. 2 is a side view of a reamer used in FIG. 1.

Turning to FIG. 2, the reamer 20 is shown in more detail. The intermediate section 24, first end 26, and second end 28 of the elongate body 22 of the reamer 20 are shown. The circumference of the intermediate section 24 is preferably larger than the circumference of the first end 26 and the second end 28. The reamer 20 may comprises different shapes and sizes as needed. For example, the first end 26 or the second end 28 may be conical or the circumference of the first end 26 or the second end 28 may be substantially similar to the circumference of the intermediate section 24. The reamer 20 may be formed from a heat treated steel alloy of sufficient strength, various high strength nickel alloys, stainless steel materials, or other sufficiently strong materials known in the art for use with horizontal directional drilling operations.

Figure 3:
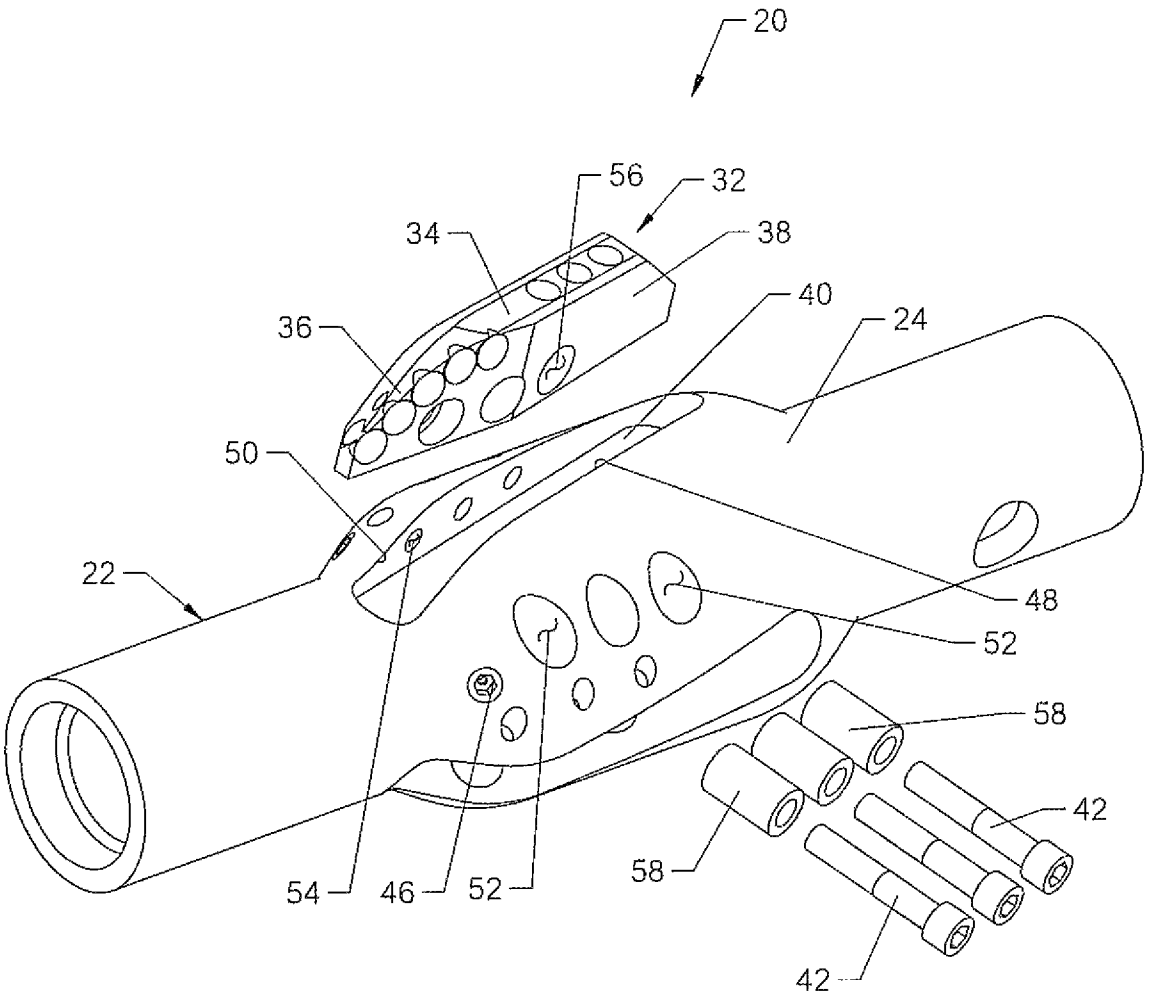
FIG. 3 is a partially exploded view of the reamer of FIG. 2.

Continuing with FIG. 2, a plurality of cutters 32 are shown attached to the outer circumference of the intermediate section 24. The cutters 32 comprise an edge 34, a leading edge 36, and a body 38. The cutter 32 attaches to the intermediate section 24 by inserting into a pocket 40 formed in the intermediate section, as shown in FIG. 3. The cutter 32 is maintained within the pocket 40 via the use of a fastener 42. The fastener 42 may comprise a retaining screw or other fasteners known in the art for use with mechanical equipment. The reamer 20 may have a plurality of the pockets 40 formed on the intermediate section 24 of the reamer, as shown in FIG. 3. A plurality of the cutters 32 may be secured within the plurality of the pockets 40, as shown in FIG. 2. Preferably, the reamer 20 will comprise the same amount of pockets 40 as the cutters 32. In addition, a plurality of the fasteners 42 may be used to secure each cutter 32 within each pocket 40, as shown in FIG. 2.

The cutter or plurality of cutters 32 may have a plurality of cutter elements or polycrystalline diamond compact (PDC) inserts 44 affixed to the leading edge 36 and the edge 34 of the cutter 32, as shown in FIG. 2. The PDC inserts 44 engage with and shear the sides of the borehole 16 (FIG. 1) during operation. Alternatively, tungsten carbide cutters or other suitable wear-resistant cutting elements may be used in place of the PDC inserts 44.

The cutters 32 are shown secured with the pockets 40 (FIG. 3) in FIG. 2. The pocket or plurality of pockets 40 may be machined into the intermediate section 24 along the length of the intermediate section. The pocket 40 may be formed at an angle $\alpha$ to the longitudinal axis 41 of the elongate body 22, as shown in FIG. 2, such that all of or a portion of the pocket 40 is not parallel to the rotational axis of the intermediate section 24. The angle $\alpha$ at which the pocket 40 may be machined in the intermediate section 24 may be between 10 and 15 degrees. However, greater or lesser angles may be used if needed. By machining the pocket 40 at this angle, the rotation of the reamer 20 within the borehole 16 (FIG. 1) causes the trailing end of the cutter 32, or the end of the cutter 32 closest to the second end 28 of the elongate body 22, to generate a pumping action to help force drilling fluid and cuttings out of the borehole. Alternatively, the pocket 40 could be machined parallel to the longitudinal axis 41 of the elongate body 22 and a portion of the cutter 32 could be machined or bent at an angle to provide a similar pumping action.

Continuing with FIG. 2, the cutter 32 is shown secured within the pocket 40 (FIG. 3) with at least a portion of the cutter at the angle $\alpha$ to the longitudinal axis 41 of the elongate body 22. The leading edge 36 of the cutter 32 is shown substantially parallel to the longitudinal axis 41 of the elongate body 22 in FIG. 2. This allows the leading edge 36 of the cutter 32 to engage the borehole 16 at a position parallel to the longitudinal axis 41 of the elongate body 22 of the reamer 20. Aligning the leading edge 36 of the cutter 32 with the longitudinal axis 41 of the reamer aids in placing the PDC inserts 44 at an orientation where they engage the underground formation at an angle producing the optimum cutting efficiency and minimizing wear on the PDC inserts.

The reamer 20, shown in FIG. 2, further comprises a plurality of fluid nozzles 46 formed on the elongate body 22. The fluid nozzles 46 may be spaced apart about the elongate body 22. The fluid nozzles 46 may be formed proximate the leading edge 36 of the cutter 32. The leading edge 36 of the cutter 32 will typically first contact the rock or ground formation surrounding the borehole 16 during back-reaming operations. The fluid nozzles 46 provide a pathway for drilling fluid supplied to the reamer 20 to be sprayed into the borehole 16 (FIG. 1) during back-reaming operations. The fluid nozzles 46 are oriented such that they spray drilling fluid directly on the face of the borehole 16 for removal and flushing of rock and soil cuttings during operation. The fluid nozzles 46 may also be oriented such that they spray onto the cutters 32 to assist in cleaning and cooling the cutters during operation.

Turning now to FIG. 3, the pocket 40 is shown in more detail. The pocket 40 comprises a first side 48 and a second side 50. A passage 52 may be formed within the intermediate section 24 that intersects with the first side 48 of the pocket 40 preferably at a right angle, although other angles of intersection could be utilized. A plurality of the passages 52 may be formed within the intermediate section 24 proximate one another and intersecting with the first side 48 of the pocket 40, as shown in FIG. 3. A corresponding passage 54 may also be formed in the intermediate section 24 directly opposite the passage 52. The corresponding passage 54 may intersect with the second side 50 of the pocket 40 at a right angle or at the same angle the passage 52 intersects the first side 48 of the pocket 40. The corresponding passage 54 may comprise a tapped hole. A plurality of the corresponding passages 54 may be formed within the intermediate section 24 proximate one another, directly opposite the plurality of passages 52, and intersecting with the second side 50 of the pocket 40, as shown in FIG. 3. There will preferably be the same amount of passages 52 as there are corresponding passages 54. The fluid nozzle 46 is also shown in FIG. 3.

Continuing with FIG. 3, the cutter 32 is shown in more detail. The edge 34, the leading edge 36, and the body 38 of the cutter 32 are shown. The cutter 32 comprises a hole 56 which passes through the width of the body 38 of the cutter. When the cutter 32 is inserted into the pocket 40, the hole 56 will be directly in line with the passage 52 and the corresponding passage 54. A plurality of the holes 56 may be formed in the cutter 32 proximate one another, as shown in FIG. 3. The plurality of holes 56 will be in line with the plurality of passages 52 and the plurality of corresponding passages 54 when the cutter 32 is inserted into the pocket 40. There will preferably be the same amount of holes 56 as there are passages 52 and corresponding passages 54.

A plurality of the fasteners 42 are also shown in FIG. 3. The fastener 42 passes through the passage 52, the hole 56, and the corresponding passage 54 in order to secure the cutter 32 to the intermediate section 24. A clamp bushing 58 may be inserted into the passage 52 and extend into the hole 56 prior to passing the fastener 42 through the passage. The fastener 42 will pass through the clamp bushing 58 and then pass through the hole 56 and the corresponding passage 54. A plurality of the clamp bushings 58 may be used with the plurality of passages 52, as shown in FIG. 3. The clamp bushing 58 may be made of hardened allow steel, stainless steel, suitable nickel alloy or other metallic alloys. Alternatively, the clamp bushings 58 may be made of a ceramic material or other non-metallic material of sufficient compressive strength clamp bushings 58 may contain an internal threads or other feature to assist with removal of the clamp bushings 58 from reamer 20.

Continuing with FIG. 3, the clamp bushing 58 provides a larger bearing surface for the loading contact between the cutter 32 and the fastener 42. This helps to prevent localized yielding of material in the cutter 32 during back-reaming operations which could lead to loss of preload on the fasteners 42. The clamp bushing 58 may be machined such that it has a close sliding fit with the passage 52 in the intermediate section 24 and the hole 56 in the cutter 32. The diametrical clearance between the clamp bushing 58, the passage 52, and the hole 56 may be 0.010 inches or less. However, this clearance may be greater if desired. The clamp bushing 58 also spans the gap between the hole 56 in the cutter 32 and the passage 52 in the intermediate section 24. This provides a greater cylindrical bearing area to secure the cutter 32 within the pocket 40 than the fastener 42 alone provides. This helps to prevent the cutter 32 from being ripped from the pocket 40 during operation. The clamp bushing 58 further provides an extended "grip length" for the fastener 42. By having a longer grip length, the fastener 42 acts more like a spring and is less likely to lose preload which could result in the fastener coming loose in the intermediate section 24 of the elongate body 22 or the reamer 20.

Figure 4:
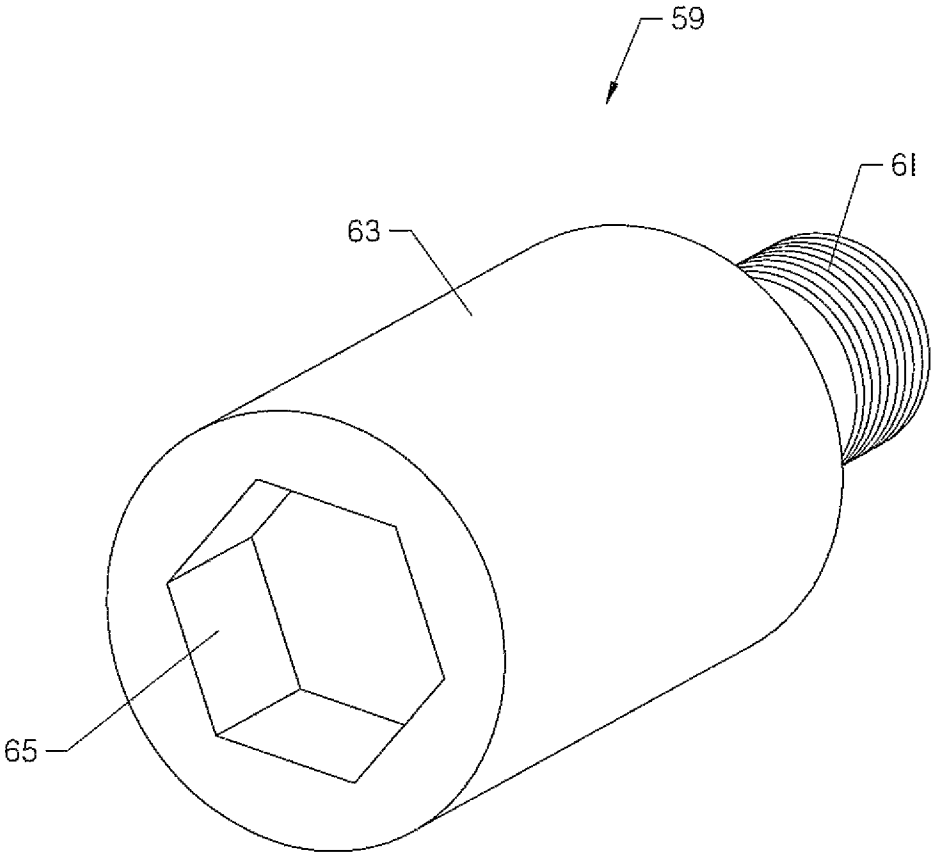
FIG. 4 is a perspective view of an alternate clamp bushing for use with the reamer.

Turning now to FIG. 4, an alternate clamp bushing 59 for use with the invention is shown. The fastener 42 (FIG. 3) is integral with the clamp bushing 58 (FIG. 3) in the alternate clamp bushing 59. The alternate clamp bushing comprises a threaded end 61, a body 63, and a socket 65 formed, within the body 63. The socket 65 may engage with a corresponding socket (not shown) formed in the hole 56 of the cutter 32 (FIG. 3). Similarly, a second alternate clamp bushing 59 may be disposed within the second passage 54 and engaged with a second corresponding socket (not shown) formed in the hole 56 of the cutter 32.

Referring back to FIG. 3, the cutter or plurality of cutters 32 may be replaced with like cutters or cutters of a different size and shape. This allows an operator to use the same elongate body 22 of the reamer 20 and just replace the cutters 32 if the cutters become worn during operation. The cutters 32 may be replaced with cutters of differing heights, allowing the same elongate body 22 of the reamer 20 to be used to enlarge the borehole 16 to different diameters. The cutters formed with a different profile along the edge 34 of the cutter 32 may also be used if needed. The cutters that may be used to replace the cutters 32 already secured to the intermediate section 24 may each have an identical pattern of cutting elements 44 and 60 (FIG. 4) along the leading edge 36 and the edge 34 of the cutter to improve the ability to freely interchange the cutters 32 when needed. The PDC inserts 44 or cutting elements 60 may be uniquely spaced on each cutter 32 so that a full set of cutters equal to the number of pockets 40 may be used to effectively cut the entire surface area at the leading end of the borehole 16.

Figure 5A:
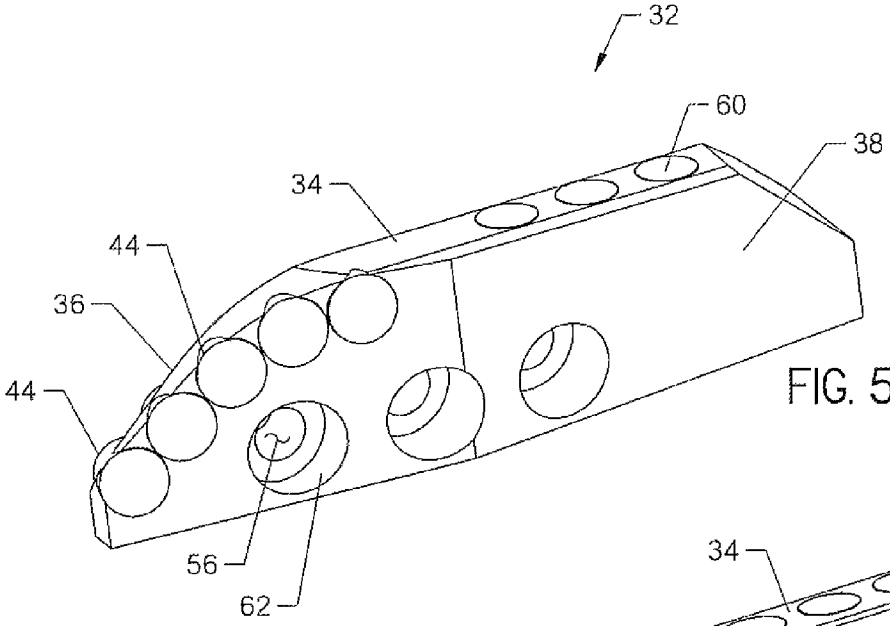
FIG. 5A is a perspective view of a cutter for use with the reamer.
Figure 5B:
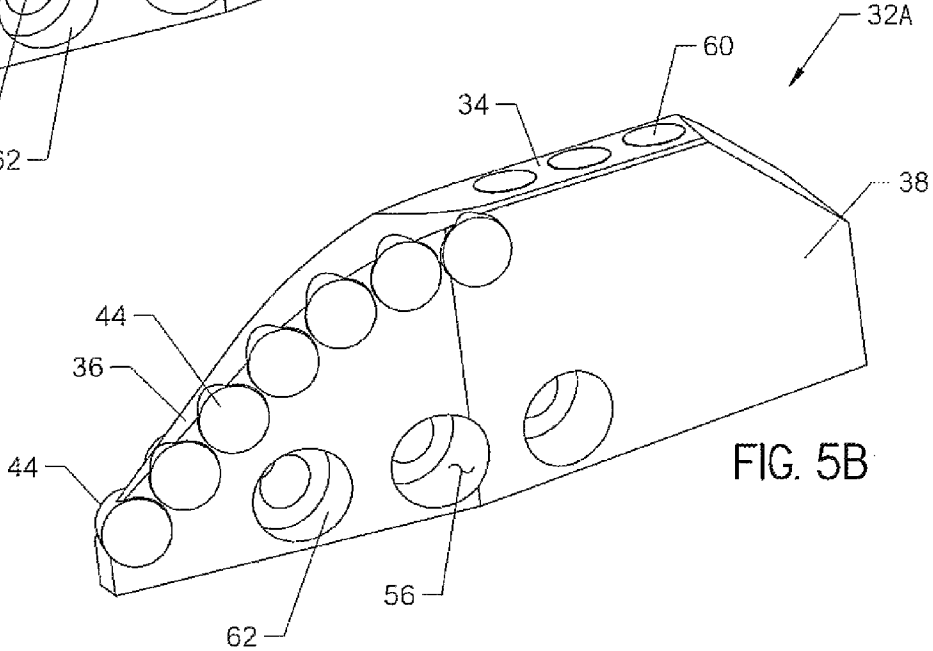
FIG. 5B is a perspective view of an alternative cutter for use with the reamer.

Turning now to FIGS. 5A and 5B, the cutter 32 and a different sized cutter 32*a* are shown in more detail. The body 38 of the cutter 32*a* is taller than the body 38 of the cutter 32. Thus, the cutter 32*a* may be used to enlarge the borehole 16 (FIG. 1) to a larger diameter than cutter 32. Both the cutters 32 and 32*a* may be used with the same elongate body 22. The cutter 32 and 32*a* may be interchanged depending on the desired enlarged borehole 16 size. FIGS. 5A and 5B also show the PDC inserts 44 affixed along the leading edge 36 of the cutter 32 and 32*a*. The edge 34 of the cutter 32 and 32*a* may also comprise a series of cutting elements or wear resistant buttons 60 which may contact the walls of the enlarged borehole 16 as the reamer 20 is rotated within the borehole (FIG. 1). The buttons 60 help to reduce wear to the body 38 of the cutter 32 and 32*a*. The buttons 60 may be made of tungsten carbide, PDC, or any other material of sufficient strength known in the art. Hard-facing welding rods could also be applied to the edge 34 of the cutter 32 and 32*a* to prevent wear on the body 38 of the cutter.

Continuing with FIGS. 5A and 5B, the hole or plurality of holes 56 formed in the cutter 32 and 32*a* are shown in more detail. The hole 56 comprises a counter-bore 62. The counter-bore 62, allows the clamp bushing 58 (FIG. 3) to partially extend into the hole 56 formed in the body 38 of the cutter 32. Once the fastener 42 passes through the hole 56 it secures to the corresponding passage 54 formed on the second side 50 of the pocket 40 (FIG. 3). The fastener 42 may thread into a tapped hole formed in the corresponding passage 54 or it may be tightly engaged with the corresponding passage 54. Alternatively, the fastener 42 may only secure to or thread into the cutter 32 or 32*a* and the corresponding passages 54 may not be present. As a second alternative, the fastener 42 may pass through the passage 52 and secure to or thread into the cutter 32 or 32*a*, and a corresponding fastener may pass through the corresponding passage 54 and secure to or thread into the cutter on its opposite side. As a third alternative, pins could be used to retain the cutter 32 or 32*a*, or removable solder or brazing material could be used to retain the cutter 32 or 32*a* within the pocket 40.

Figure 6:
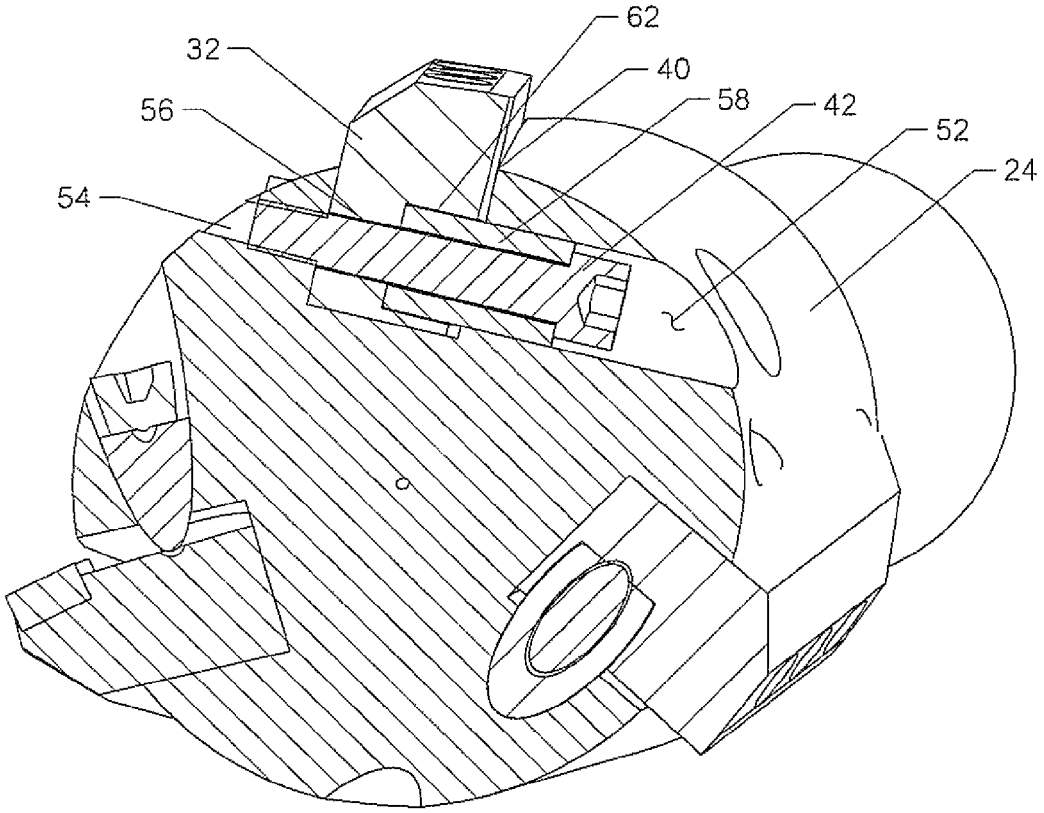
FIG. 6 is a section view along line I-I from FIG. 2.

Turning now to FIG. 6, a section view along line I-I from FIG. 2 is shown. FIG. 6 shows one option for securing the cutter 32 within the pocket 40. The cutter 32, in FIG. 6, is shown inserted within the pocket 40 formed on the intermediate section 24. The fastener 42 is shown disposed within the passage 52, the clamp bushing 58, the hole 56, and the second passage 54. The clamp bushing 58 is shown within the counter-bore 62.

Figure 7:
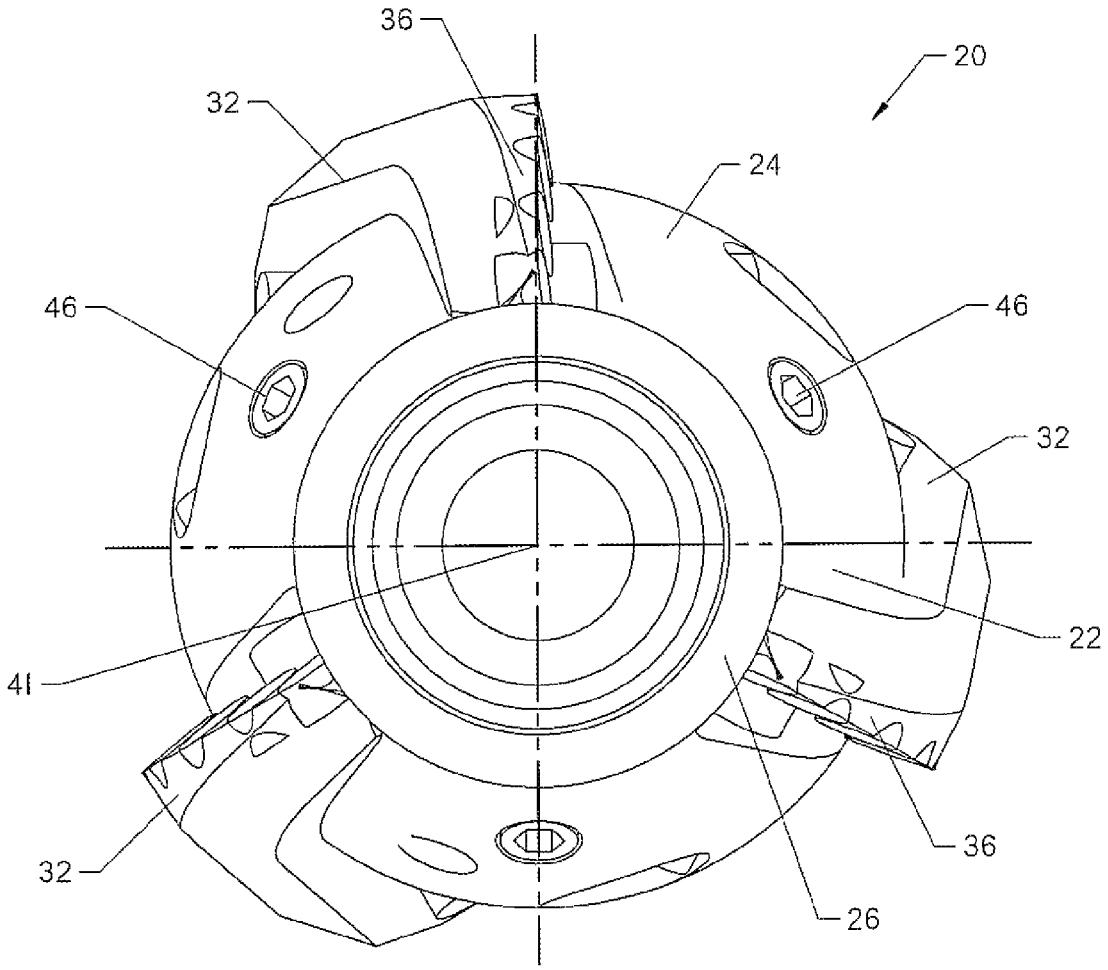
FIG. 7 is a front view of the reamer looking down its longitudinal axis.

Referring now to FIG. 7, the first end 26 of the reamer 20 is shown looking down the longitudinal axis 41 of the elongate body 22. Three cutters 32 are shown secured within three pockets 40 (FIG. 3) formed on the intermediate section 24 of the elongate body 22. The intermediate section 24 may comprise less than three pockets 40 and cutters 32 or more than three pockets 40 and cutters 32 if desired. The fluid nozzles 46 are also shown spaced apart on the elongate body 22 proximate the leading edge 36 of the cutters 32. In operation, should any of the plurality of cutters 32 become worn and ineffective, one or all of the cutters may be replaced with like cutters as needed. This allows the operator to continue back-reaming operations without having to replace the entire reamer 20. The operator may also use the same elongate body 22 of the reamer 20 to enlarge different sized boreholes by replacing the cutters 32 with cutters of different shapes and sizes.

Various modifications can be made in the design and operation of the present invention without departing from its spirit. Thus, while the preferred construction and modes of operation of the invention have been explained in what is now considered to represent its best embodiments, it should be understood that within the scope of the appended claims, the invention may be practiced otherwise than as specifically illustrated and described.

What is claimed is:

1. A reamer having a first end section and an enlarged coaxial body that are joined by a medial portion having a tapered profile, a pocket formed in the body at an angle to a longitudinal axis of the reamer and having an open end that contacts the medial portion, and a non-rotatable cutter at least partially positioned within the pocket and having a first cutting surface that joins a second cutting surface at a non-straight angle, in which the first cutting surface is parallel to the longitudinal axis of the reamer.

2. The reamer of claim 1 further comprising at least one passage formed within the body and intersecting the pocket.

3. The reamer of claim 2 further comprising a corresponding passage formed within the body and intersecting the pocket directly opposite the passage.

4. The reamer of claim 2 wherein the at least one passage is perpendicular to the pocket.

5. The reamer of claim 1 wherein the first cutting surface and the second cutting surface each carry a plurality of hardened inserts.

6. A reamer having a first end section and an enlarged coaxial body that are joined by a medial portion having a tapered profile, a pocket having an open end that contacts the medial portion, and a non-rotatable cutter at least partially positioned within the pocket, the reamer further comprising a clamp bushing intersecting the pocket and a portion of the cutter, and a fastener positioned within the clamp bushing and extending entirely through the cutter.

7. The reamer of claim 6 wherein the clamp bushing has a threaded portion and an end in which a socket is formed.

8. A method for enlarging a borehole formed during horizontal directional drilling operations, the method comprising:

providing a reamer comprising:

an elongate body comprising an intermediate section, a first end, and a second end, wherein the intermediate section has a circumference larger than the circumference of the first end and the second end;

a pocket formed in the intermediate section at an angle to a longitudinal axis of the reamer; and a non-rotatable cutter at least partially positioned within the pocket, the cutter comprising:

a first cutting surface that joins a second cutting surface at a non-straight angle, in which the first cutting surface is parallel to the longitudinal axis of the reamer;

connecting the first end of the elongate body to a drill pipe;

connecting the second end of the elongate body to a swivel;

pulling the reamer through the borehole while rotating the reamer such that the cutter contacts and enlarges the borehole; and securing the cutter to the intermediate section of the elongate body by passing a fastener through at least one passage formed within the intermediate section and through at least one hole formed in the cutter.

9. The method of claim 8 further comprising passing a clamp bushing through the at least one passage and a portion of the at least one hole formed in the cutter and passing the fastener through the clamp bushing and entirely through the cutter.

* * * * *